US011111733B2

(12) United States Patent
Magnuson

(10) Patent No.: US 11,111,733 B2
(45) Date of Patent: Sep. 7, 2021

(54) DRILLING ASSEMBLIES

(71) Applicant: Nabors Drilling Technologies USA, Inc., Houston, TX (US)

(72) Inventor: Christopher Magnuson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 16/696,725

(22) Filed: Nov. 26, 2019

(65) Prior Publication Data

US 2020/0181988 A1 Jun. 11, 2020

Related U.S. Application Data

(60) Provisional application No. 62/776,819, filed on Dec. 7, 2018.

(51) Int. Cl.
*E21B 15/00* (2006.01)
*E21B 19/06* (2006.01)

(52) U.S. Cl.
CPC ..... *E21B 15/00* (2013.01); *E21B 19/06* (2013.01)

(58) Field of Classification Search
CPC ..... E21B 15/00; E21B 19/06; E21B 19/08; E21B 19/087
See application file for complete search history.

(56) References Cited

U.S. PATENT DOCUMENTS 1,972,269 A * 9/1934 Lewis ..... E21B 15/00 52/651.05
2,781,108 A * 2/1957 Selberg etal. ..... E21B 15/00 52/119
3,016,992 A * 1/1962 Wilson ..... E21B 15/00 52/115
3,754,361 A * 8/1973 Branham et al. ..... E21B 19/00 166/377
4,290,495 A * 9/1981 Elliston ..... E21B 19/02 254/285
4,390,162 A * 6/1983 Woolslayer ..... E21B 19/02 254/398
4,796,863 A * 1/1989 Reed ..... E21B 19/02
5,762,279 A * 6/1998 Horton, III ..... E21B 15/00 254/285
6,217,258 B1 * 4/2001 Yamamoto et al. .... E21B 15/02 405/201

(Continued)

*Primary Examiner* — James G Sayre
(74) *Attorney, Agent, or Firm* — Abel Schillinger, LLP; Enrique Abarca

(57) ABSTRACT

A drilling assembly that can include a first mast, a second mast, a water table coupled between the first and second masts, and a plurality of sheaves coupled to the water table and adapted to translate along a plane oriented generally perpendicular to a height of at least one of the first or second mast. A drilling assembly that can include a mast having a generally C-shaped support structure, as viewed from a top view, and an opening disposed within the support structure, where the mast is disposed adjacent to a wellbore, and where the opening is adapted to permit passage of tubulars from an external position to the wellbore through the mast. A drilling assembly that can include a mast, a water table coupled to the mast, and a drawworks disposed adjacent to the mast, where the drawworks is adapted to laterally translate relative to the mast.

15 Claims, 3 Drawing Sheets

(56) References Cited

U.S. PATENT DOCUMENTS

| | | | | |
|---|---|---|---|---|
| 8,671,626 | B1 | 3/2014 | Marty et al. | |
| 8,844,616 | B2 | 9/2014 | Krohn et al. | |
| 8,955,602 | B2 * | 2/2015 | Pilgrim | E21B 19/00 166/377 |
| 9,551,196 | B2 | 1/2017 | Layden | |
| 9,822,593 | B2 | 11/2017 | Eilertsen et al. | |
| 9,834,998 | B2 | 12/2017 | Holck | |
| 2016/0024852 | A1 * | 1/2016 | Kannegaard | E21B 3/02 175/5 |
| 2017/0152713 | A1 | 6/2017 | Dowdy et al. | |
| 2018/0044995 | A1 * | 2/2018 | Braniff | E21B 19/14 |
| 2018/0058160 | A1 | 3/2018 | Magnuson | |

* cited by examiner

DRILLING ASSEMBLIES

CROSS-REFERENCE TO RELATED APPLICATION(S)

This application claims priority under 35 U.S.C. § 119(e) to U.S. Patent Application No. 62/776,819, entitled "DRILLING ASSEMBLIES," by Christopher MAGNUSON, filed Dec. 7, 2018, which application is assigned to the current assignee hereof and incorporated herein by reference in its entirety.

FIELD OF THE DISCLOSURE

The present disclosure relates to drilling assemblies.

RELATED ART

Drilling assemblies are generally utilized for drilling wellbores within subterranean formations during oil and gas exploration. Land based drilling assemblies typically include a single mast raised above a drill floor. The mast suspends a driving unit, such as a top drive, to bias a drill string into the subterranean formation.

Due to their modular nature to permit transport between job sites, land based drilling assemblies are often basic and devoid of advanced functionality that can assist the drillers in optimizing performance and drilling efficiency. For instance, while dual activity land-based drilling (i.e., drilling with two or more top drives operating in concert) can increase wellbore efficiency, supporting aspects of drilling assemblies to further enhance drilling efficiency are lacking.

Due to the complex nature of drilling assemblies and the cost of operating, the exploration and production of natural resources continues to demand improvements.

BRIEF DESCRIPTION OF THE FIGURES

The present disclosure may be better understood, and its numerous features and advantages made apparent to those skilled in the art by referencing the accompanying drawings.

DETAILED DESCRIPTION

Figure 1:
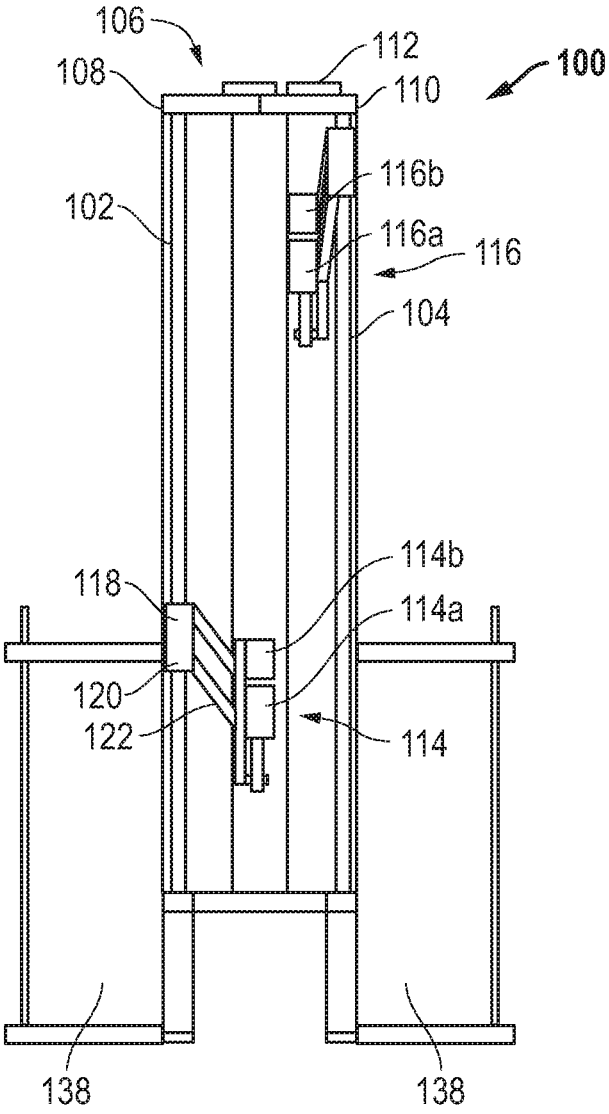
FIG. 1 includes a simplified side view of a drilling assembly in a first position in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

As used herein, "generally equal," "generally same," and the like refer to deviations of no greater than 10%, or no greater than 8%, or no greater than 6%, or no greater than 4%, or no greater than 2% of a chosen value. For more than two values, the deviation can be measured with respect to a central value. For example, "generally equal" refer to two or more conditions that are no greater than 10% different in value. Demonstratively, angles offset from one another by 98% are generally perpendicular.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

In accordance with an aspect described herein, a drilling assembly can include a plurality of masts, such as a first mast and a second mast. A water table can be coupled between the first and second masts. A plurality of sheaves can be coupled to the water table and adapted to translate along a plane oriented generally perpendicular to a height of at least one of the first or second masts.

In an embodiment, the water table can include a first portion engageable with the first mast and a second portion engageable with the second mast. The first and second portions can be engageable with one another. In a particular embodiment, the first and second portions of the water table can have generally same sizes as one another, generally same shapes as one another, generally same functions as one another, or any combination thereof.

In an embodiment, at least one of the plurality of sheaves is adapted to translate along a line extending generally between the first and second masts. For instance, the at least one of the plurality of sheaves can be adapted to translate at least 0.1 meters (m), at least 0.25 m, at least 0.5 m, at least 1 m, at least 2 m, or at least 3 m.

In certain instances, at least one of the plurality of sheaves can be coupled to the water table through an adjustable interface. The adjustable interface can permit translation of the at least one of the plurality of sheaves. In a particular embodiment, the adjustable interface can include a rail system.

In accordance with another aspect, a drilling assembly can generally include a mast having a generally C-shaped support structure, as viewed from a top view. An opening can be disposed within the generally C-shaped support structure. The mast can be disposed adjacent to a wellbore and the opening can be adapted to permit passage of tubulars from an external position to the wellbore through the mast.

In certain instances, the opening can have a height no less than a length of tubular to be passed through the opening. In certain embodiments, the opening can have a height of no less than 3 m, no less than 5 m, no less than 8 m, no less than 10 m, or no less than 15 m. In certain instances, the opening can be adapted to permit passage of a tubular stand including a plurality of tubulars.

In an embodiment, at least a portion of the opening can be disposed at a vertical elevation below a drill floor of the drilling assembly. In a more particular embodiment, a majority of the opening can be disposed at a vertical elevation below the drill floor. In another embodiment, at least a portion of the opening can be disposed at a vertical elevation above the drill floor of the drilling assembly. In a more particular embodiment, a majority of the opening can be disposed at a vertical elevation above the drill floor. In certain instances, the opening can be disposed fully above ground level.

In an embodiment, the drilling assembly can further include a tubular setback disposed outside of the generally C-shaped support structure. The opening can be disposed between the tubular setback and the wellbore.

In certain instances, the drilling assembly can further include one or more removable structural members adapted to be disposed within the opening. The one or more removable structural members can be adapted to close the opening, such as when the opening is not in use or during transit.

In an embodiment, the drilling assembly can include a secondary mast having a generally C-shaped support structure, as viewed from a top view. The previously described mast can be joined with the secondary mast, such as coupled together by a water table. In an embodiment, the C-shaped mast and secondary mast can define an internal working area around the wellbore. In another embodiment, the first and second masts can be spaced apart from one another by the wellbore. More particularly, the first and second masts can be spaced apart by the water table.

In a particular embodiment, the secondary mast can have an opening adapted to permit passage of tubulars through the secondary mast to the wellbore.

In an embodiment, the drilling assembly can include a plurality of top drives, such as a first top drive associated with the mast and a second top drive associated with the second mast. At least one of the first and second top drives can be adapted to engage with the tubular as it passes through the opening from the tubular setback.

In accordance with another aspect, a drilling assembly can include a mast, a water table coupled to the mast, and a drawworks disposed adjacent to the mast and adapted to laterally translate relative to the mast.

The drilling assembly can include a plurality of sheaves disposed on the mast and moveable in a direction along a first line. The drawworks can be moveable along a second line generally parallel with the first line.

In an embodiment, the drawworks and at least one of the plurality of sheaves can be adapted to move in unison with one another. In a more particular embodiment, all of the plurality of sheaves can be adapted to move with the drawworks.

In an embodiment, an angle of a drilling line extending from the drawworks to at least one of the plurality of sheaves can be adapted to remain at a generally fixed angle as the plurality of sheaves are moved in a direction along the first line.

Referring to FIG. 1, a drilling assembly 100 can generally include a first mast 102 and a second mast 104 coupled together at a water table 106. In an embodiment, the water table 106 is disposed at, or adjacent to, an upper end of the first and second masts 102 and 104. The water table 106 can include a first portion 108 and a second portion 110. The first portion 108 can be coupled with the first mast 102 and the second portion 110 can be coupled with the second mast 104. In certain instances, the first and second portions 108 and 110 can have generally same sizes as one another, generally same shapes as one another, generally same functionality as one another, or any combination thereof.

In an embodiment, the first and second portions 108 and 110 can be adapted to couple together with one another. More particularly, the first and second portions 108 and 110 can be adapted to be removably coupled together. By way of non-limiting example, the first and second portions 108 and 110 can be coupled together by a removable interface including, for example, a removable pin, a lock, a fastener, another interface, or any combination thereof.

During installation of the drilling assembly 100 at a job site, the first and second masts 102 and 104 can be erected and coupled together at the water table 106. In a particular instance, the first portion 108 of the water table 106 can be precoupled with the first mast 102 and the second portion 110 of the water table 106 can be precoupled with the second mast 104. In this regard, the first and second masts 102 and 104 can be raised and coupled together without requiring the addition of the first or second portions 108 or 110 once in the raised position.

Figure 4:
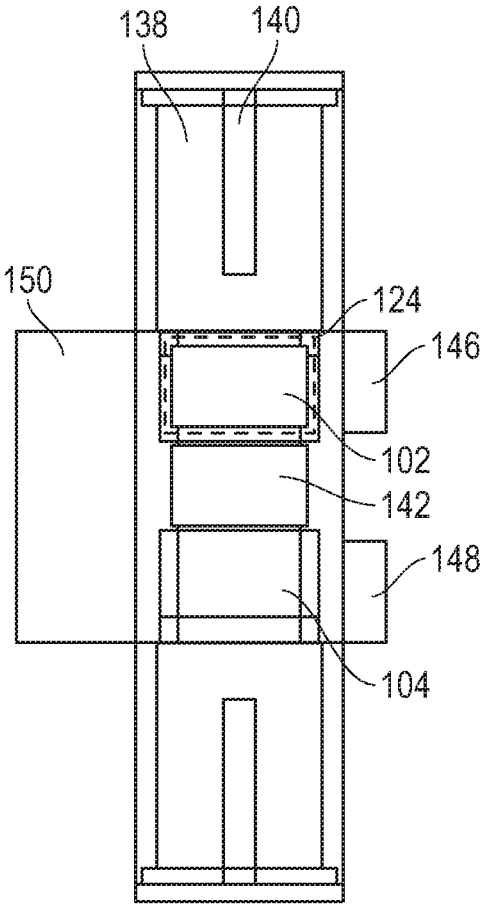
FIG. 4 includes a simplified top view of the drilling assembly in accordance with an embodiment.

The water table 106 can define a receiving area for receiving a plurality of sheaves 112. The plurality of sheaves 112 can be coupled to the water table 106, such as along an upper surface thereof. In an embodiment, the plurality of sheaves 112 can be adapted to receive a drill line (not illustrated) extending between one or more travelling assemblies 114 and 116 (including for example, one or more top drives 114*a* and 116*a* and traveling blocks 114*b* and 116*b*) supported by the drilling assembly 100 and one or more drawworks 146 and 148 (FIG. 4). Skilled artisans will recognize after reading the entire disclosure contained herein that at least one the traveling assemblies 114 and 116, such as both of the traveling assemblies 114 and 116, can be comprised of various configurations. In a particular instance, at least one of the traveling assemblies 114 or 116 can include a traveling block, a traveling block interface, and a rotating drilling component. The traveling block interface can include, for example, a direct couple, a becket, a hook, another suitable interface, or any combination thereof. The rotating drilling component can include, for example, a swivel and kelly, a top drive, a rotary table with slips, another suitable rotating drilling component, or any combination thereof.

At least one of the plurality of sheaves 112 can be adapted to translate along a plane oriented generally perpendicular to a height of at least one of the first or second masts 102 or 104. At least one of the plurality of sheaves 112 can be adapted to translate along a line oriented perpendicular to the height of the at least one of the first or second masts 102 or 104. The line can extend generally between the first and second masts 102 and 104. In a more particular instance, the line can be parallel with a line spanning a shortest distance between the first and second masts 102 and 104.

The plurality of sheaves 112 can be adapted to translate at least 0.1 m, at least 0.25 m, at least 0.5 m, at least 1 m, at least 2 m, or at least 3 m. The plurality of sheaves 112 can be adapted to translate no greater than 10 m, no greater than 7 m, or no greater than 5 m. More particularly, the sheaves 112 can be adapted to translate no further than the first or second masts 102 and 104. That is, for example, the sheaves 112 can be disposed between or directly above the first and second masts 102 and 104 at all times.

The sheaves 112 can be coupled to the water table 106 through an adjustable interface (not illustrated) adapted to permit translation of the sheaves 112 relative to at least one of the first and second masts 102 and 104. The adjustable interface can include a rail system. The rail system can extend generally between the first and second masts 102 and 104. The sheaves 112 can be mounted to the rail system, such as to one or more rails of the rail system in a manner so as to permit movement of the sheaves with respect to the one or more rails. The rail system can include stop features adapted to secure the sheaves 112 at a fixed location relative to the first and second masts 102 and 104. The stop features can include set stop areas wherein the sheaves 112 can be selectively stopped and selectively locked relative to the rail system so as to restrict movement thereof. The stop features can also include brakes, grippers adapted to engage with the rail system, counterbalances, rams and hydraulic actuators, other similar features, or any combination thereof.

Figure 2:
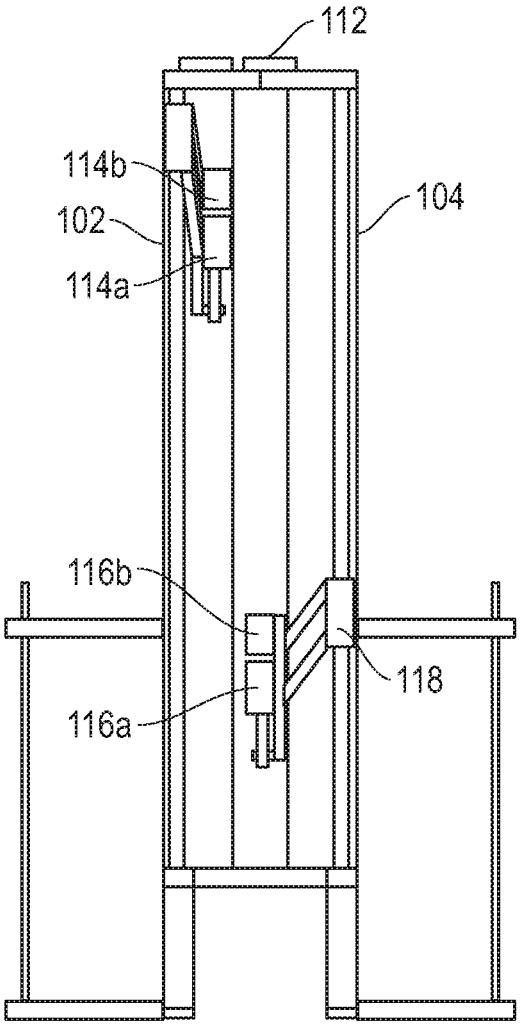
FIG. 2 includes a simplified side view of the drilling assembly in a second position in accordance with an embodiment.

The sheaves 112 illustrated in FIG. 1 are depicted closer to the second mast 104 than the first mast 102. FIG. 2 illustrates a view of the sheaves 112 closer to the first mast 102 as compared to the second mast 104. While illustrated for simplicity of understanding, those of skill in the art will recognize that the sheaves 112 can be arranged in any readily known configuration with respect to one another. For instance, in certain embodiments the plurality of sheaves 112 can include a plurality of parallel sheaves and an offset sheave disposed communicatively between the parallel sheaves and the drawworks so as to receive the drill line from the drawworks.

Referring to FIGS. 1 and 2, the drilling assembly 100 can include a plurality of traveling assemblies (including, for example, the first traveling assembly 114 and the second traveling assembly 116). The first and second traveling assemblies 114 and 116 can be adapted to operate in concert with one another. In such a manner, the first and second traveling assemblies 114 and 116 can permit dual activity drilling. For instance, the first traveling assembly 114 can be actively involved in rotating a drill string extending into the wellbore while the second traveling assembly 116 engages with an auxiliary tubular to be added to the drill string after the first traveling assembly 114 finishes its travel along the mast 102. The second traveling assembly 116 can then position the auxiliary tubular relative to the drill string for coupling therewith and being rotating the drill string into the wellbore while the first traveling assembly 114 can engage with another auxiliary tubular to be added to the drill string after the second traveling assembly 116 finishes its travel along the mast 102. This process can be repeated as necessary to advance the wellbore into the underlying geological formation.

FIG. 1 illustrates active drilling with the first top drive 114*a* and auxiliary functionality of the second top drive 116. FIG. 2 illustrates active drilling with the second top drive 116*a* and auxiliary functionality of the first top drive 114*a*. It should be understood that dual activity drilling can include operations in addition to active drilling and tubular placement on the drill string. That is, for instance, dual activity drilling can include casing placement, tripping in and tripping out, and other similar drilling operations that may occur before, during, or after wellbore development.

At least one of the first and second top drives 114*a* and 116*a* can be coupled to its respective mast 102 or 104 by a moveable linkage. For instance, the top drives 114*a* and 116*a* can be coupled to the first and second masts 102 and 104 by retractable dollies 118 adapted to translate along the masts 102 and 104. The retractable dollies 118 can include a carriage 120 adapted to translate along the mast 102 or 104 and a pivotable linkage 122 coupled with the carriage 120 and extending to the top drive 114*a* or 116. The top drive 114*a* or 116*a* can thus be laterally advanced toward or retracted away from the wellbore to permit vertical passage of the top drives 114*a* and 116*a* with respect to one another.

In certain instances, such as those illustrated in FIGS. 1 and 2, the sheaves 112 can be laterally aligned with at least one of the traveling assemblies 114 and 116. In such a manner, the sheaves 112 can better support the traveling assemblies 114 and 116 without lateral loading thereupon. Subsequently, force leveraged through the retractable dollies 118 can be reduced as compared to instances where the sheaves 112 are stationary. Reduced force can enhance longevity and reduce premature wear and failure of the drilling assembly 100.

Referring to FIG. 4, at least one of the masts 102 and 104 can have a generally C-shaped support structure, as viewed from a top view. The C-shaped support structure is generally illustrated by a dashed line 124 in FIG. 4. The C-shaped support structure can include curved segments, linear segments, or a combination thereof. The C-shaped support structure can have equal length side segments or the C-shaped support structure can have unequal side segment lengths.

In a more particular embodiment, both the first and second masts 102 and 104 can have generally C-shaped support structures, as viewed from a top view. In a particular embodiment, the C-shaped support structures can be oriented toward one another. That is, the lateral opening in the C-shaped support structures can face one another. The first and second masts 102 and 104 can be reflectively symmetrical, or generally reflectively symmetrical, about the wellbore or an area near the wellbore. The first and second masts 102 and 104 can be rotationally symmetrical about the wellbore or an area near the wellbore. The first and second masts 102 and 104 can be rotationally and reflectively symmetrical about the wellbore or an area near the wellbore. The first and second masts 102 and 104 can be nonsymmetrical.

Figure 3:
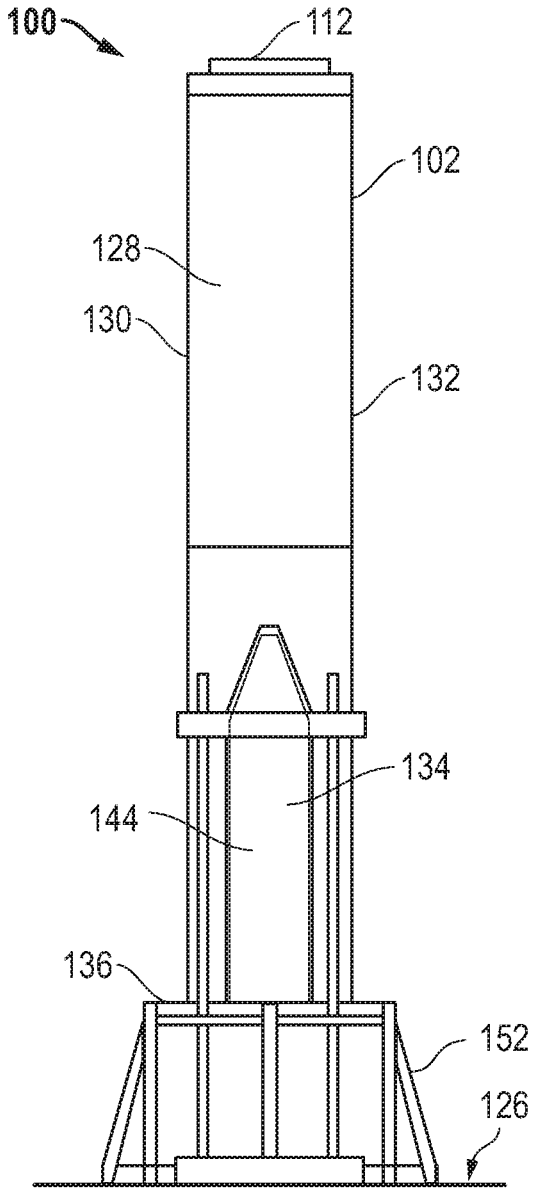
FIG. 3 includes a simplified front view of the drilling assembly in accordance with an embodiment.

FIG. 3 illustrates a front view of the drilling assembly 100 in accordance with an embodiment. The mast 102 can extend from a ground level 126 vertically upward. The sheaves 112 can form an uppermost portion of the drilling assembly 100. In certain instances, the mast 102 can have a solid, or generally solid front surface 128. The solid front surface 128 can include a continuous surface. The generally solid front surface 128 can include a grid of supports extending between vertical, or generally vertical, supports 130 and 132. The grid of supports can generally be impassable to tubulars. That is, tubulars can generally be prevented from passing through the front surface 128 to get to the wellbore. More particularly, the tubulars can be prevented from passing through the front surface 128 while in a vertical orientation.

The mast 102 can include an opening 134. The opening 134 can be adapted to permit passage of tubulars from an external position to the wellbore through the mast 102. The opening 134 can be disposed along the front surface 128. In the illustrated embodiment, the opening 134 is defined by two vertical sides and an upper frustum portion. In another embodiment, the opening 134 can be defined by two vertical sides joined together by a horizontal, or generally horizontal, top. In yet another embodiment, the opening 134 can include an arcuate profile defined by a curved top. In yet a further embodiment, the opening 134 can include arcuate segments, linear segments, or combinations thereof.

The opening 134 can define a height, $H_O$, as measured by a height of the opening 134 at a location where tubulars can pass therethrough. In an embodiment, $H_O$ can be measured from the ground level 126. In another embodiment, $H_O$ can be measured from a drill floor 136 of the drilling assembly 100. In yet another embodiment, $H_O$ can be measured between a lower and upper portion of the opening 134, wherein neither the lower or upper portions correspond with the ground level 126 or the drill floor 136.

In an embodiment, at least a portion of the opening 134 can be disposed at a vertical elevation below the drill floor 136. In another embodiment, at least a portion of the opening 134 can be disposed at a vertical elevation above the drill floor 136. In yet a more particular embodiment, at least a portion of the opening 134 can be disposed below the drill floor 136 and at least a portion of the opening 134 can be disposed above the drill floor 136.

In an embodiment, at least one of the masts 102 and 104 can be disposed on at least 2 legs 152 rising from the ground level 126, at least 3 legs 152 rising from the ground level 136, or at least 4 legs 152 rising from the ground level 126. In a particular embodiment, the masts 102 and 104 can be supported by at least 8 legs 152. Whereas traditional drilling assemblies utilize a reduced number of legs, embodiments described herein can include at least 8 legs for enhanced support and structural rigidity.

Referring again to FIG. 1, in an embodiment, the drilling assembly 100 can include a tubular setback 138 disposed outside of an area defined between the first and second masts 102 and 104. The tubular setback 138 can be used to store tubulars that are yet to be added to the drill string or that have been removed therefrom. For instance, during tripping operations, it is common to add or remove tubulars in relatively rapid succession. The tubulars can be selected from or stored within the tubular setback 138.

As illustrated, the drilling assembly 100 can include tubular setbacks 138 associated with each of the masts 102 and 104, each of the traveling assemblies 114 and 116, or both. In an embodiment, at least one of the tubular setbacks 138 can be disposed at a vertical elevation at least partially below the drill floor 136. In another embodiment, both of the tubular setbacks 138 can be disposed at a vertical elevation at least partially below the drill floor 136.

Referring to FIG. 4, in an embodiment, at least one of the tubular setbacks 138 can include one or more guiding elements 140 adapted to guide or maintain the tubulars in desired locations within the tubular setback 138. The one or more guiding elements 140 can include racks, rods, supports, ramped surfaces, or combinations thereof to guide or maintain the tubulars in desired locations. In an embodiment, the one or more guiding elements 140 can include a latch adapted to support the tubulars within the tubular setback during dangerous environmental conditions such as high winds.

The tubular setback 138 can be disposed outside of the area defined by the masts 102 and 104. In an embodiment, the opening 134 can be disposed between the tubular setback 138 and the wellbore 142. In a more particular embodiment, the opening 134 can lie along a line intersecting both the wellbore 142 and the tubular setback 138.

In an embodiment, the first and second masts 102 both include openings 134. The openings 134 can be the same or similar as compared to one another. For instance, both openings 134 can have a same height, same width, same shape, same vertical placement along the masts 102 and 104, or any combination thereof. In another embodiment, the openings 134 can be different from one another. That is, for example, the openings 134 can have different heights as compared to one another, different widths as compared to one another, different shapes as compared to one another, different vertical placements along the masts 102 and 104 as compared to one another, or any combination thereof. In a particular instance, the openings 134 can lie along a line that intersects both tubular setbacks 138 and the wellbore 142.

The drilling assembly 100 can include one or more removable structural members 144 adapted to be disposed within the opening 134 to close the opening 134. Closure of the opening 134 may be desirable during non-drilling times when the driller may want to reduce operational danger, in certain environmental conditions, during transportation, or during any combination thereof. To close the opening 134, an operator or machine can position the one or more removable structural members 144 adjacent to the opening 134. An optional securing mechanism (not illustrated) can be utilized to secure the one or more removable structural members 144 to the mast 102 or 104 and maintain the opening 134 in a closed configuration.

In an embodiment, the drilling assembly 100 can further include one or more drawworks. The one or more drawworks can include, for instance, a first drawworks 146 and a second drawworks 148. In an embodiment, at least one of the one or more drawworks can be adapted to move relative to at least one of the masts 102 and 104. In a more particular embodiment, at least one of the one or more drawworks can be adapted to move relative to both of the masts 102 and 104. In yet a more particular embodiment, all of the one or more drawworks can be adapted to move relative to both of the masts 102 and 104. In an embodiment, the drawworks can be adapted to translate relative to the masts 102 and 104. In a more particular embodiment, the drawworks can be adapted to laterally translate relative to the masts 102 and 104.

Figure 5:
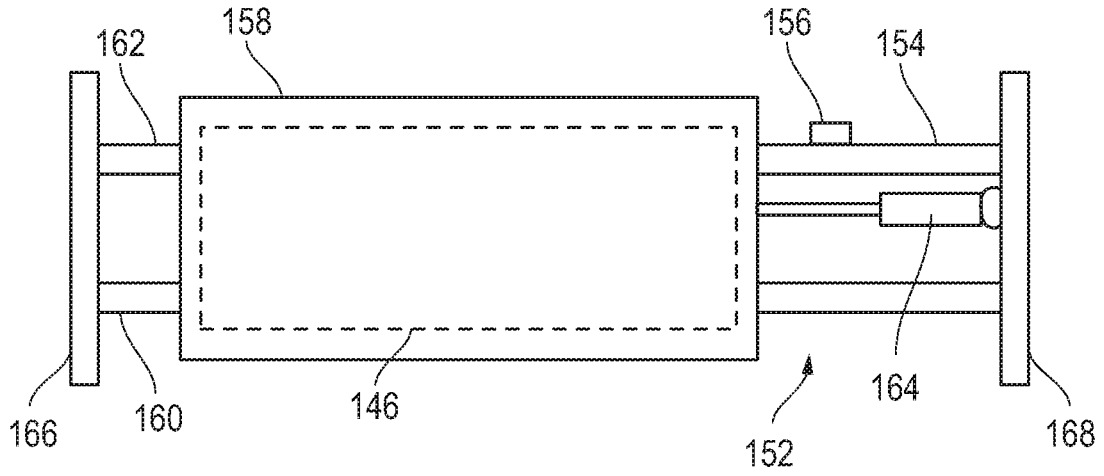
FIG. 5 includes a simplified top view of a moveable drawworks in accordance with an embodiment.

Referring to FIG. 5, in accordance with an embodiment, the drawworks 146 or 148 (hereinafter referred to as drawworks 146) can be coupled with an adjustable system 152 adapted to permit translation of the drawworks 146 relative to the masts 102 or 104. In a particular embodiment, the adjustable system 152 can include a rail system 154 adapted to permit translation of the drawworks 146 relative thereto. The rail system 154 can span a distance between supports 166 and 168. The supports 166 and 168 can be coupled with a skid, a portion of the drilling assembly 100, the ground, another suitable location, or any combination thereof. A sensor 156 can be utilized to track the relative position of the drawworks 146 with respect to the masts 102 or 104. In a particular embodiment, the sensor 156 can be an encoder adapted to track the relative position of the drawworks 146. In another embodiment, the sensor 156 can include an optical sensor, a tactile sensor, an acoustic sensor, another suitable sensor, or any combination thereof.

In certain instances, the adjustable system 152 can include a receiving area 158 adapted to receive the drawworks 146. The receiving area 158 can be coupled with the rail system 154. In the illustrated embodiment, the receiving area 158 is defined by a platform coupled with a first rail 160 and a second rail 162 of the rail system 154. In a particular embodiment, the platform can include a level upper surface. In another embodiment, the rail system 154 can include a single rail. In yet another embodiment, the rail system 154 can include at least three rails, at least four rails, or at least five rails. In an embodiment, the receiving area 158 can be biased along the rail system 154 by a biasing element 164. The biasing element 164 can include, for example, an acme screw, a hydraulic actuator, a pneumatic actuator, an electrical ram, a motor, another known biasing element, or any combination thereof. By way of non-limiting example, the biasing element 164 can be coupled with one or both of the supports 166 and 168. One or more bearings can interconnect the receiving area 158 and rail system 154 to permit translation with reduced frictional interference.

In certain instances, movement of the adjustable system 152 can occur upon user-specified instructions. In other instances, movement of the adjustable system 152 can occur autonomously, or at least partially autonomously.

In an embodiment, at least one of the plurality of sheaves 112 is adapted to move in a direction along a first line. The drawworks 146 can be moveable along a second line parallel, or generally parallel, with respect to the first line. In such a manner, an angle of the drilling line extending from the drawworks 146 to at least one of the plurality of sheaves 112 can be adapted to remain at a constant, or generally constant, angle when the plurality of sheaves 112 are moved in a direction along the first line. Moving the drawworks 146 with the sheaves 112 can reduce wear of the drawworks 146 and sheaves 112. Moving the drawworks 146 with the sheaves 112 can further extend operational lifespan of the drilling assembly 100 by reducing stress on the components associated therewith. In an embodiment, the drilling line can have a Δ angle no greater than +/−1.5° as the sheaves 112 move, no greater than +/−1.0° as the sheaves 112 move, no greater than +/−0.5° as the sheaves 112 move, no greater than +/−0.25° as the sheaves 112 move, no greater than +/−0.1° as the sheaves 112 move, or no greater than +/−0.05° as the sheaves 112 move. In a particular embodiment Δ angle can be no greater than +/−1° as the sheaves 112 move. Maintenance of a constant, or generally constant, Δ angle of the drilling line can reduce damage to the drilling line that might otherwise occur when pressure between the drilling line and drawworks 146 or sheaves 112 is off-axis from the optimal angle of rotational movement thereof. In particular, maintaining a constant, or generally constant, Δ angle can reduce drilling line fray and wear. Maintaining a constant, or generally constant, Δ angle can limit damage and wear to the sheaves and their associated bearings due to side loading caused by fleet angles greater than 1.5°.

In an embodiment, the drawworks 146 and sheaves 112 are adapted to move in unison. The drawworks 146 and sheaves 112 can be operated, for example, by a logic element, including for example a microprocessor, adapted to move the drawworks 146 and sheaves 112 simultaneously. In another embodiment, the drawworks 146 and sheaves 112 can be moved simultaneously by the driller. The microprocessor can be in communication with one or more sensor positioned on the drawworks 146, sheaves 112, drilling line, or any combination thereof. The one or more sensors can be adapted to detect the relative position of the drawworks 146, sheaves 112, drilling line, or any combination thereof. In another embodiment, the microprocessor can be in communication with the drawworks 146 or a sensor adapted to monitor a condition of the drawworks 146, such as the relative positioning of the drawworks 146 with respect to the masts 102 or 104.

In an embodiment, the microprocessor can be in communication with a storage device or secondary logic element. In a particular embodiment, the microprocessor can run programming adapted to monitor the relative positions of the drawworks 146 and sheaves 112. In another particular embodiment, the microprocessor can be adapted to run programming to control the relative positions of the drawworks 146 and sheaves 112.

In certain instances, a driller's cabin 150 can be disposed adjacent to the masts 102 and 104 opposite the drawworks 146. The driller's cabin 150 can house electronics, processing equipment, computers, and quarters for the drillers on the drilling assembly 100.

In an embodiment, a user interface can be disposed on the drilling assembly 100 to permit driller adjustment of the drawworks 146, sheaves 112, or both. The user interface can permit operator override of the programmed activity of the drilling assembly 100. In particular, the user interface can permit operator control of the top drive dual activity, movement of the drawworks 146, movement of the sheaves 112, or any combination thereof.

In a particular embodiment, a drilling assembly 100 in accordance with an embodiment described herein can include a first mast 102, a second mast 104, a two portion water table 106 coupled between the first and second masts 102 and 104, and a plurality of sheaves coupled to the water table 106 and adapted to move along a plane oriented generally perpendicular to a height of at least one of the first or second masts 102 or 104. The drilling assembly 100 can further include an opening 136 in at least one of the masts 102 or 104 for passing tubulars from a tubular setback 138 disposed outside of an area defined by the first and second masts 102 and 104 through the mast 102 or 104. In yet a more particular embodiment, the drilling assembly 100 can include at least one adjustable drawworks 146 or 148 adapted to translate laterally during translational movement of the sheaves 112.

In certain instances, drilling assemblies 100 in accordance with embodiments described herein can affect more efficient wellbore drilling operations. Further, drilling assemblies 100 in accordance with embodiments described herein can reduce part wear and fatigue, thereby increasing operational lifetime of the drilling assembly. Yet further, drilling assemblies 100 in accordance with embodiments described herein can provide new and useful ways of moving tubulars between storage areas and wellbores.

Embodiment 1

A drilling assembly comprising:
- a first mast;
- a second mast;
- a water table coupled between the first and second masts; and
- a plurality of sheaves coupled to the water table and adapted to translate along a plane oriented generally perpendicular to a height of at least one of the first or second mast.

Embodiment 2

The drilling assembly of embodiment 1, wherein the water table comprises a first portion and a second portion, wherein the first portion is engageable with the first mast and the second portion is engageable with the second mast, and wherein the first and second portions are engageable with one another.

Embodiment 3

The drilling assembly of embodiment 2, wherein the first and second portions have generally same sizes as one another, generally same shapes as one another, generally same functions as one another, or any combination thereof.

Embodiment 4

The drilling assembly of embodiment 1, wherein at least one of the plurality of sheaves is translatable along a line extending generally between the first and second masts.

Embodiment 5

The drilling assembly of embodiment 1, wherein at least one of the plurality of sheaves is adapted to translate at least 0.25 m, at least 0.5 m, at least 1 m, at least 2 m, or at least 3 m.

Embodiment 6

The drilling assembly of embodiment 1, wherein the plurality of sheaves are coupled to the water table through an adjustable interface, such as a rail system.

Embodiment 7

A drilling assembly comprising:

a mast having a generally C-shaped support structure, as viewed from a top view, and an opening disposed within the generally C-shaped support structure, wherein the mast is disposed adjacent to a wellbore, and wherein the opening is adapted to permit passage of tubulars from an external position to the wellbore through the mast.

Embodiment 8

The drilling assembly of embodiment 7, wherein the opening has a height no less than a length of the tubular to be passed through the opening.

Embodiment 9

The drilling assembly of embodiment 7, wherein at least a portion of the opening is disposed at a vertical elevation below a drill floor of the drilling assembly.

Embodiment 10

The drilling assembly of embodiment 9, wherein at least a portion of the opening is disposed at a vertical elevation above the drill floor.

Embodiment 11

The drilling assembly of embodiment 7, further comprising a tubular setback disposed outside of the generally C-shaped support structure.

Embodiment 12

The drilling assembly of embodiment 11, wherein the opening is disposed between the tubular setback and the wellbore.

Embodiment 13

The drilling assembly of embodiment 7, further comprising one or more removable structural members adapted to be disposed within the opening to close the opening.

Embodiment 14

The drilling assembly of embodiment 7, further comprising a secondary mast having a generally C-shaped support structure, as viewed from a top view, wherein the mast and secondary mast are coupled together by a water table.

Embodiment 15

The drilling assembly of embodiment 14, further comprising a plurality of top drives including at least a first top drive associated with the mast and a second top drive associated with the second mast, and wherein at least one of the first and second top drives is adapted to engage with the tubular as it passes through the opening from a tubular setback.

Embodiment 16

The drilling assembly of embodiment 14, wherein the mast and second mast are spaced apart from one another by the wellbore.

Embodiment 17

A drilling assembly comprising:

a mast;

a water table coupled to the mast; and a drawworks disposed adjacent to the mast, wherein the drawworks is adapted to laterally translate relative to the mast.

Embodiment 18

The drilling assembly of embodiment 17, further comprising a plurality of sheaves disposed on the mast and moveable in a direction along a first line, wherein the drawworks is moveable along a second line generally parallel with the first line.

Embodiment 19

The drilling assembly of embodiment 18, wherein the drawworks and the plurality of sheaves are adapted to move in unison.

Embodiment 20

The drilling assembly of embodiment 17, wherein an angle of a drilling line extending from the drawworks to at least one of the plurality of sheaves is adapted to remain at a generally fixed angle when the plurality of sheaves are moved in a direction along the first line.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The invention claimed is:

1. A drilling assembly comprising: a first mast; a second mast; a water table coupled between the first and second masts; and a first plurality of sheaves coupled to the water table and adapted to translate, relative to the first mast, in a first horizontal direction along a first plane oriented generally perpendicular to a height of at least one of the first or second mast; and a first drawworks disposed in a receiving area with the receiving area adapted to translate, relative to the first mast, in the first horizontal direction along a second plane that is parallel to the first plane.

2. The drilling assembly of claim 1, wherein the water table comprises a first portion and a second portion, wherein the first portion is engageable with the first mast and the second portion is engageable with the second mast, and wherein the first and second portions are engageable with one another.

3. The drilling assembly of claim 2, wherein the first and second portions have generally same sizes as one another, generally same shapes as one another, generally same functions as one another, or any combination thereof.

4. The drilling assembly of claim 1, further comprising:

a second plurality of sheaves coupled to the water table and adapted to translate, relative to the second mast, in a second horizontal direction along the first plane; and a second drawworks adapted to translate, relative to the second mast, in the second horizontal direction along the second plane that is parallel to the first plane.

5. The drilling assembly of claim 4, wherein the second plurality of sheaves and the second drawworks translate in unison in the second horizontal direction.

6. The drilling assembly of claim 1, wherein the first plurality of sheaves and the first drawworks translate in unison in the first horizontal direction.

7. A drilling assembly comprising: a first mast; a water table coupled to the first mast; and a first drawworks disposed in a receiving area disposed adjacent to the first mast, wherein the receiving area is adapted to laterally translate relative to the first mast; and a first plurality of sheaves disposed on the water table and adapted to laterally translate relative to the first mast in a direction along a first line, wherein the receiving area is adapted to laterally translate relative to the first mast along a second line generally parallel with the first line.

8. The drilling assembly of claim 7, further comprising:

a second mast;

a second drawworks disposed adjacent to the second mast, wherein the second drawworks is adapted to laterally translate relative to the second mast; and a second plurality of sheaves disposed on the second mast and adapted to laterally translate in a direction along the first line, wherein the second drawworks is adapted to laterally translate in a direction along the second line generally parallel with the first line.

9. The drilling assembly of claim 8, wherein the first drawworks and the first plurality of sheaves are adapted to move in unison, and wherein the second drawworks and the second plurality of sheaves are adapted to move in unison.

10. The drilling assembly of claim 7, wherein an angle of a drilling line extending from the first drawworks to at least one of the first plurality of sheaves is adapted to remain at a generally fixed angle when the first plurality of sheaves is moved in a direction along the first line.

11. The drilling assembly of claim 1, further comprising:

a first traveling block coupled to the first plurality of sheaves; and a first pivotable linkage coupled between the first mast and the first traveling block, the first pivotable linkage being slidably coupled to the first mast and configured to move the first traveling block toward or away from the first mast.

12. The drilling assembly of claim 11, further comprising:

a first top drive coupled to the first traveling block, wherein the first top drive moves in unison with the first traveling block as the first pivotable linkage moves the first traveling block toward or away from the first mast.

13. The drilling assembly of claim 12, wherein the first plurality of sheaves, the first drawworks, the first traveling block, and the first top drive move horizontally in unison.

14. The drilling assembly of claim 12, further comprising:

a second plurality of sheaves coupled to the water table and adapted to translate, relative to the second mast, in a second horizontal direction along the first plane; and a second drawworks adapted to translate, relative to the second mast, in the second horizontal direction along the second plane that is parallel to the first plane.

15. The drilling assembly of claim 14, further comprising:

a second traveling block coupled to the second plurality of sheaves;

a second pivotable linkage coupled between the second mast and the second traveling block, the second pivotable linkage being slidably coupled to the second mast and configured to move the second traveling block toward or away from the second mast; and a second top drive coupled to the second traveling block, wherein the second top drive moves in unison with the second traveling block as the second pivotable linkage moves the second traveling block toward or away from the second mast.

* * * * *